US008891998B2

(12) United States Patent
Hirakawa et al.

(10) Patent No.: US 8,891,998 B2
(45) Date of Patent: Nov. 18, 2014

(54) IMAGE FORMING APPARATUS INCLUDING LOUVERS FOR DIRECTING AIRFLOW

(71) Applicant: Kyocera Document Solutions Inc., Osaka (JP)

(72) Inventors: Hiroyuki Hirakawa, Osaka (JP); Keiichi Tanida, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 26 days.

(21) Appl. No.: 13/790,901

(22) Filed: Mar. 8, 2013

(65) Prior Publication Data

US 2013/0236207 A1 Sep. 12, 2013

(30) Foreign Application Priority Data

Mar. 9, 2012 (JP) ..... 2012-052969

(51) Int. Cl.
*G03G 21/20* (2006.01)

(52) U.S. Cl.
CPC ..... *G03G 21/206* (2013.01)
USPC ..... 399/92; 399/69; 454/279

(58) Field of Classification Search
USPC ..... 399/69, 92; 454/279, 355
See application file for complete search history.

(56) References Cited

U.S. PATENT DOCUMENTS

| | | | | |
|---|---|---|---|---|
| 4,469,167 | A * | 9/1984 | Itoh et al. | 165/151 |
| 7,299,863 | B2 * | 11/2007 | Lee et al. | 165/152 |
| 7,953,343 | B2 * | 5/2011 | Kawamata | 399/92 |
| 8,651,924 | B1 * | 2/2014 | Jones et al. | 454/71 |
| 2005/0232653 | A1 | 10/2005 | Murooka | |

FOREIGN PATENT DOCUMENTS

| | | | |
|---|---|---|---|
| JP | 258756 | | 4/1990 |
| JP | 02279933 | | 11/1990 |
| JP | 2001241874 | A * | 9/2001 |
| JP | 2010-097036 | | 4/2010 |
| JP | 2011-175059 | | 9/2011 |

OTHER PUBLICATIONS

Japanese Office Action 2012-052969 dated Jun. 10, 2014, 7 pages.

* cited by examiner

*Primary Examiner* — Clayton E LaBalle
*Assistant Examiner* — Trevor J Bervik
(74) *Attorney, Agent, or Firm* — K&L Gates LLP

(57) ABSTRACT

An image forming apparatus according to the present disclosure includes a fan, a first louver, and a second louver. The first louver includes first rectifier vanes that direct airflow produced by the fan. The second louver is located on an inner side of an apparatus body with respect to the first louver and faces the first louver in such a manner as to overlap the first louver in a direction of an axis of rotation of the fan. The second louver includes second rectifier vanes that direct the airflow produced by the fan. Each of the first rectifier vanes and a corresponding one of the second rectifier vanes that is adjacent thereto extend in one plane inclining at a specific angle with respect to the axis of rotation of the fan.

5 Claims, 5 Drawing Sheets

IMAGE FORMING APPARATUS INCLUDING LOUVERS FOR DIRECTING AIRFLOW

INCORPORATION BY REFERENCE

This application is based upon, and claims the benefit of priority from the corresponding Japanese Patent Application No. 2012-052969, filed on Mar. 9, 2012, the entire contents of which are incorporated herein by reference.

BACKGROUND

The present disclosure relates to image forming apparatuses such as copiers, printers, facsimiles, and multifunction peripheral each having the foregoing functions, and particularly to an image forming apparatus including louvers that direct airflow produced by a fan that cools the inside of an apparatus body.

In general, an image forming apparatus forms an image through the following process. First, the surface of an image carrier, such as a photoconductor drum, is uniformly charged by a charging device. Subsequently, an electrostatic latent image is formed on the image carrier through exposure performed by an exposure device and is visualized into a toner image by a developing device. After the toner image is transferred to a recording medium, a fixing device performs a fixing operation on the toner image. In this process, members such as a power supply board, that supplies power to the fixing device, and other devices included in the apparatus may generate a substantial amount of heat. The heat generated from these devices can increase the temperature inside the apparatus. Such heat may adversely affect image quality and lead to an apparatus failure.

To release the heat generated in the body of the image forming apparatus to the outside, the image forming apparatus may include a fan. For example, the apparatus may include a first louver located at the openable manual feed tray, and a second louver located at the housing on which the manual feed tray is positioned. The second louver faces the manual feed tray that is in a closed state. Furthermore, an exhaust fan is positioned in the housing at a position facing the second louver. Air in the housing is exhausted through the second louver by the exhaust fan. The air that has passed through the second louver is exhausted through the first louver to the outside.

In another example of an image forming apparatus, a first louver is located on an openable cover, and a second louver is located on a side cover. When the openable cover is closed, the first louver faces the second louver and an intake fan located on an apparatus body. Outside air is taken into the apparatus body by the intake fan through the first louver and the second louver and is used for cooling of a fixing device and other members.

In each of the above image forming apparatuses, the first louver and the second louver direct airflow produced by the fan. There is a large gap between the first louver and the second louver. Therefore, air from other places tends to flow into the gap between the first and second louvers. The air flowing from other places acts as a ventilation resistance to the airflow produced by the fan. If the ventilation resistance increases, the cooling effect may be reduced. To increase the cooling effect, the fan may be rotated at a high speed so that the volume of airflow is increased. However, if the fan is rotated at a high speed, problems may arise in that noise, such as the sound of the fan may increase, and the power consumption of the motor, or the like, that rotates the fan may increase. Moreover, in each of the above image forming apparatuses, since rectifier vanes of the first and second louvers extend horizontally, the noise generated by the fan travels straight to the outside of the apparatus body. Accordingly, the noise may grow louder.

SUMMARY

An image forming apparatus according to an embodiment of the present disclosure includes a fan, a first louver, and a second louver. The fan pulls outside air into an apparatus body or exhausts air inside the apparatus body to the outside. The first louver includes a plurality of first rectifier vanes that direct airflow produced by the fan. The second louver is located on an inner side of the apparatus body with respect to the first louver and faces the first louver in such a manner as to overlap the first louver in a direction of an axis of rotation of the fan. The second louver includes a plurality of second rectifier vanes that direct the airflow produced by the fan. In the image forming apparatus, front surfaces of each of the first rectifier vanes and a corresponding one of the second rectifier vanes that is adjacent thereto extend in one plane inclining at a specific angle with respect to the axis of rotation of the fan. Furthermore, back surfaces of each of the first rectifier vanes and a corresponding one of the second rectifier vanes that is adjacent thereto extend in one plane inclining at a specific angle with respect to the axis of rotation of the fan.

Additional features and advantages are described herein, and will be apparent from the following Detailed Description and the figures.

DETAILED DESCRIPTION

Embodiments of the present disclosure will now be described with reference to the accompanying drawings. The present disclosure is not limited to the following embodiments, and the application of the present disclosure and terms and so forth used herein are not limited to those described herein.

Figure 1:
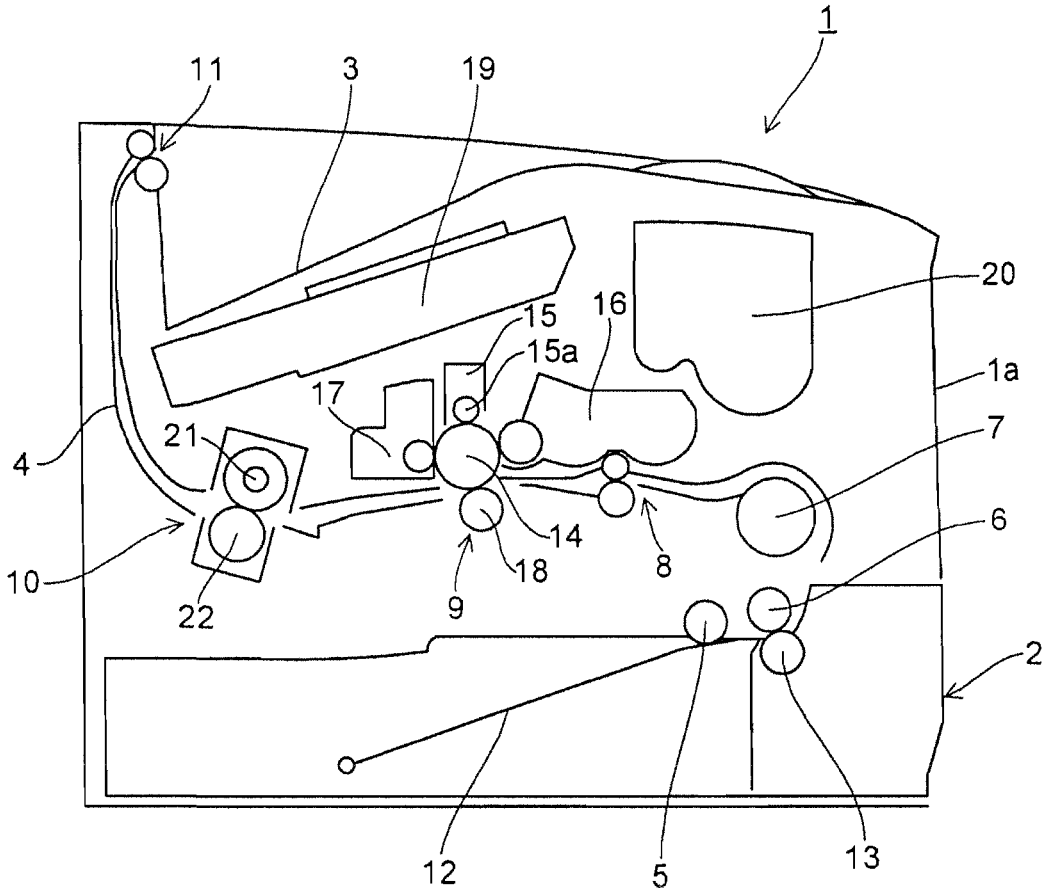
FIG. 1 is a schematic sectional view of an image forming apparatus according to an embodiment of the present disclosure.

FIG. 1 is a schematic sectional view of an image forming apparatus according to an embodiment of the present disclosure. In FIG. 1, the right side corresponds to the front side of the image forming apparatus. An image forming apparatus 1 includes an apparatus body 1*a*, at the bottom of which a paper cassette 2 that contains a stack of pieces of paper is provided. A paper transport path 4 extends above the paper cassette 2 substantially horizontally from the front side toward the rear side of the apparatus body 1*a* and then toward the upper side, reaching a paper discharge portion 3 provided at the top of the apparatus body 1*a*. A pickup roller 5, a feed roller 6, an intermediate transport roller 7, a pair of registration rollers 8, an image forming unit 9, a fixing unit 10, and a pair of discharge rollers 11 are provided in that order from the upstream side along the paper transport path 4.

The paper cassette 2 includes a paper holding plate 12 that is rotatably supported on the paper cassette 2. The paper stacked on the paper holding plate 12 are each fed toward the paper transport path 4 by the pickup roller 5. If a plurality of pieces of paper are fed at a time by the pickup roller 5, the pieces of paper are separated from one another by the feed roller 6 and a retard roller 13, whereby only the topmost piece of paper is transported. The piece of paper having been fed into the paper transport path 4 is redirected toward the rear side of the apparatus body 1*a* and is transported to the pair of registration rollers 8 by the intermediate transport roller 7. The paper is then fed to the image forming unit 9 at an adjusted timing by the pair of registration rollers 8.

The image forming unit 9 electrophotographically forms a specific toner image on the paper. Referring to FIG. 1, the image forming unit 9 includes a photoconductor 14, which corresponds to an image carrier, supported in such a manner as to be rotatable clockwise. The image forming unit 9 further includes a charging device 15, a developing device 16, and a cleaning device 17 that are located around the photoconductor 14. The image forming unit 9 further includes a transfer roller 18 located across the paper transport path 4 from the photoconductor 14, an optical scanning device 19 positioned above the photoconductor 14, and a toner container 20 located above the developing device 16 and from which toner is supplied to the developing device 16.

The charging device 15 includes a conductive rubber roller 15*a* to which a power supply (not illustrated) is connected. The conductive rubber roller 15*a* is in contact with the photoconductor 14. When the photoconductor 14 rotates, the conductive rubber roller 15*a* follows that rotation while remaining in contact with the surface of the photoconductor 14. During this rotation, a specific voltage is applied to the conductive rubber roller 15*a*, whereby the surface of the photoconductor 14 is uniformly charged.

Subsequently, a light beam is emitted from the optical scanning device 19. With the light beam, an electrostatic latent image based on image data that has been inputted to the image forming apparatus 1 is formed on the surface of the photoconductor 14. The developing device 16 supplies toner to the electrostatic latent image, whereby a toner image is formed on the surface of the photoconductor 14. Then, a piece of paper is fed at a specific timing from the pair of registration rollers 8 to a nip (transfer position) defined between the photoconductor 14 and the transfer roller 18, and the toner image on the surface of the photoconductor 14 is transferred to the paper by the transfer roller 18.

The paper having the toner image transferred thereto is separated from the photoconductor 14 and is transported toward the fixing unit 10. The fixing unit 10 is located on the downstream side with respect to the image forming unit 9 in the direction of paper transport. The paper having the toner image transferred thereto in the image forming unit 9 is heated and pressed by a heat roller 21 and a pressure roller 22 that are included in the fixing unit 10, the pressure roller 22 being pressed against the heat roller 21. Thus, the toner image having transferred to the piece of paper is fixed.

The piece of paper having undergone the above image forming process is discharged to the paper discharge portion 3 by the pair of discharge rollers 11. Meanwhile, residual toner on the surface of the photoconductor 14 remaining after the transfer is removed by the cleaning device 17. The photoconductor 14 is then charged again by the charging device 15, and another image is formed in the same manner.

Figure 2:
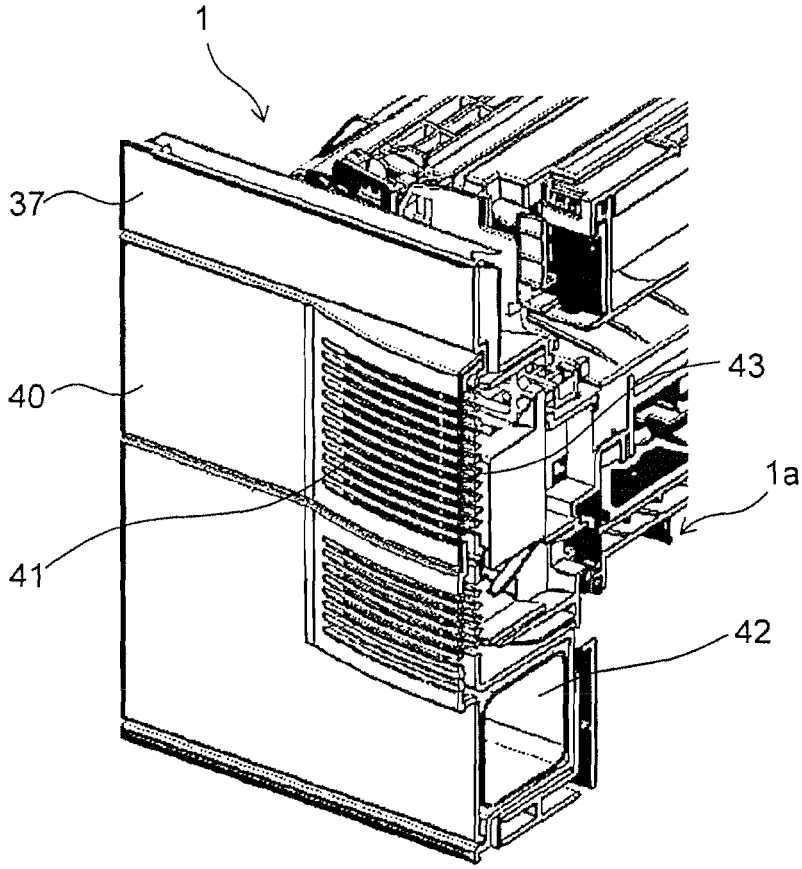
FIG. 2 is a cutout perspective view of part of the image forming apparatus illustrating a side cover, an openable cover, and other peripheral members according to the embodiment of FIG. 1.

FIG. 2 is a cutout perspective view of part of the image forming apparatus 1 illustrating a side cover 37, an openable cover 40, and other peripheral members. The exterior of the image forming apparatus 1 is formed of a front cover, a rear cover, and a top cover (all not illustrated), and the side cover 37 located on each of two sides of the apparatus.

The side cover 37, as an exterior cover, includes the openable cover 40. The openable cover 40 is rotatably supported on one side of the side cover 37 that is nearest to the rear cover (on the left side in FIG. 2). The openable cover 40 is horizontally openable about a rotating shaft. The openable cover 40 is opened to perform maintenance work, such as the replacement of a waste-toner-collecting tank 42 in the apparatus body 1*a*, and the cleaning of the charging device 15 (see FIG. 1).

The openable cover 40 includes a first louver 41. The first louver 41 is located on the outer side with respect to the exterior surface of the side cover 37. The side cover 37 includes a second louver 43. When the openable cover 40 is closed, the second louver 43 overlaps the first louver 41. The second louver 43 is located on the outer side with respect to the exterior surface of the side cover 37. The first louver 41 and the second louver 43 direct, in a specific direction, airflow produced by an intake fan to be described below.

Figure 3:
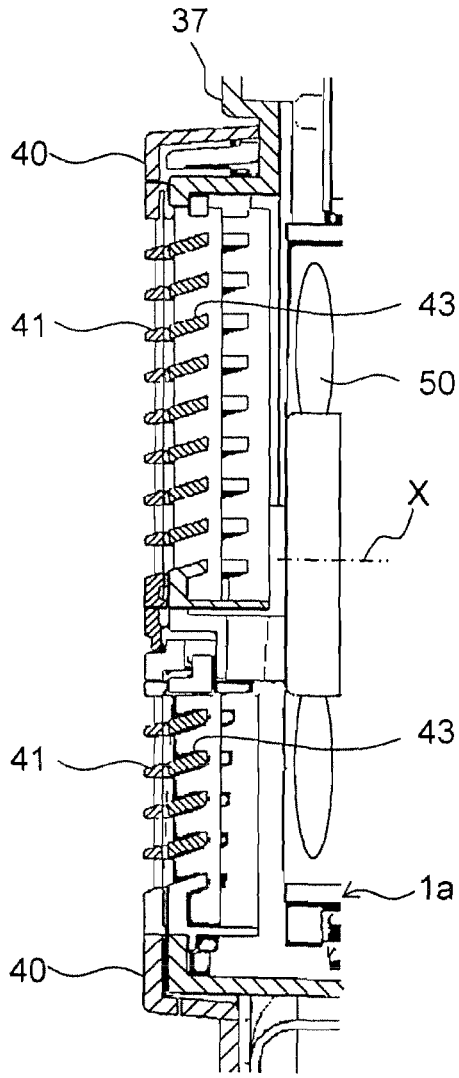
FIG. 3 is a sectional view of a first louver and a second louver according to the embodiment of FIG. 1.
Figure 4:
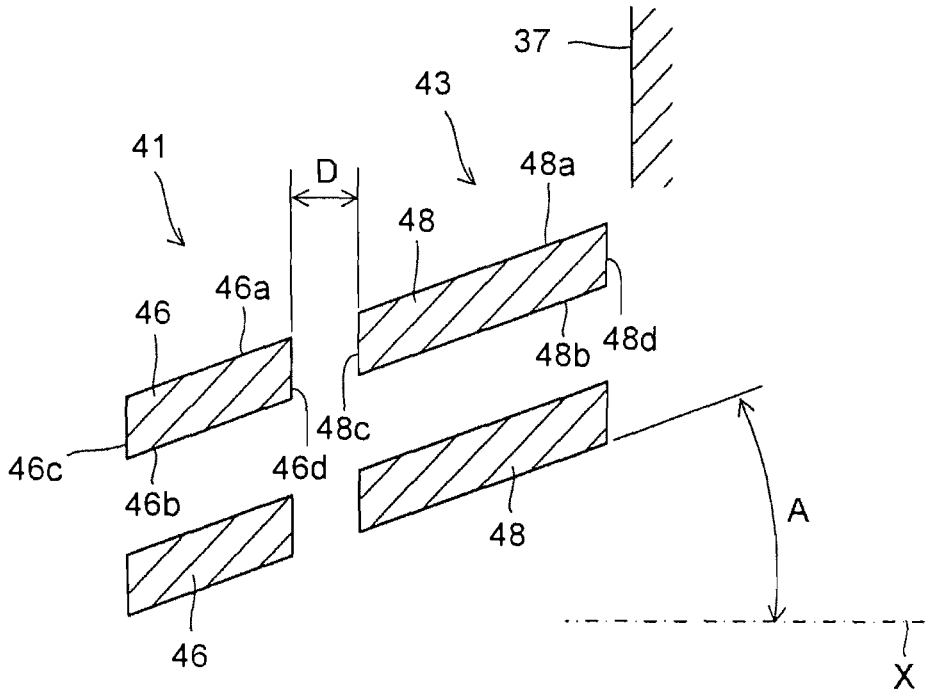
FIG. 4 is an enlarged sectional view illustrating part of the first louver and part of the second louver according to the embodiment of FIG. 1.

In an embodiment, the first louver 41 and the second louver 43 are configured as illustrated in FIGS. 3 and 4. FIG. 3 is a sectional view of the first louver 41 and the second louver 43. FIG. 4 is an enlarged sectional view schematically illustrating part of the first louver 41 and part of the second louver 43.

As illustrated in FIG. 3, the apparatus body 1*a* includes an intake fan 50. The intake fan 50 is an axial-flow fan that rotates about an axis of rotation X. When the intake fan 50 rotates, air on the outside of the apparatus body 1*a* is taken into the apparatus body 1*a* through the first louver 41 and the second louver 43, whereby the fixing unit 10 (see FIG. 1), the power supply board, and other members provided in the apparatus body 1*a* are cooled.

When the openable cover 40 is closed, the first louver 41, the second louver 43, and the intake fan 50 are positioned in that order from the outer side of the apparatus body 1*a* (from the left side in FIG. 3). The first louver 41 and the second louver 43 face each other in the direction of the axis of rotation X of the intake fan 50. The first louver 41 and the second louver 43 are spaced apart from each other with a specific gap interposed therebetween and incline at the same specific angle with respect to the axis of rotation X of the intake fan 50.

As illustrated in FIG. 4, the first louver 41 includes a plurality of first rectifier vanes 46 that are arranged side by side in the vertical direction. The first rectifier vanes 46 each have a substantially parallelogrammatic sectional shape defined by an upper surface 46*a* corresponding to the front surface, a lower surface 46*b* corresponding to the back surface, an outer end face 46*c* facing toward the outside of the apparatus body 1*a*, and an inner end face 46*d* facing toward the inside of the apparatus body 1*a*. The first rectifier vane 46 has a plate-like shape extending in the anteroposterior direction of the side cover 37 (in the depth direction in FIG. 4). The first rectifier vane 46 inclines at an angle of inclination A with respect to the axis of rotation X of the intake fan 50.

The second louver 43 includes a plurality of second rectifier vanes 48 that are arranged side by side in the vertical direction. The second rectifier vanes 48 each have a substantially parallelogrammatic sectional shape defined by an upper surface 48*a* corresponding to the front surface, a lower surface 48*b* corresponding to the back surface, an outer end face 48*c* facing toward the outside of the apparatus body 1*a*, and an inner end face 48*d* facing toward the inside of the apparatus body 1*a*. The second rectifier vane 48 has a plate-like shape extending in the anteroposterior direction of the side cover 37 (in the depth direction in FIG. 4). The second rectifier vane 48 inclines at the angle of inclination A, as with the first rectifier vane 46, with respect to the axis of rotation X of the intake fan 50. The first rectifier vane 46 and the second rectifier vane 48 may each have a substantially rectangular sectional shape.

The upper surface 48*a* of each of the second rectifier vanes 48 extends in a plane that contains the upper surface 46*a* of a corresponding one of the first rectifier vanes 46 that is adjacent thereto. The lower surface 48*b* of each of the second rectifier vanes 48 extends in a plane that contains the lower surface 46*b* of a corresponding one of the first rectifier vanes 46 that is adjacent thereto. A gap D between the inner end face 46*d* of each of the first rectifier vanes 46 and the outer end face 48*c* of a corresponding one of the second rectifier vanes 48 is set within a range of 0.1 mm or larger and 1 mm or smaller.

As described above, each of the first rectifier vanes 46 and a corresponding one of the second rectifier vanes 48 that is adjacent thereto extend in the same plane. This reduces the ventilation resistance to the airflow produced by the intake fan 50 resulting from any turbulence of airflow that may occur between the first rectifier vane 46 and the second rectifier vane 48. Consequently, the airflow produced by the intake fan 50 is efficiently directed into the apparatus body 1*a*.

Furthermore, the first rectifier vane 46 and the second rectifier vane 48 incline at the same angle with respect to the axis of rotation X of the intake fan 50. Hence, wind noise and the like generated by the rotation of the intake fan 50 is restrained from traveling straight in a horizontal direction and leaking to the outside of the apparatus body 1*a*. Consequently, noise generated by the rotation of the intake fan 50 is reduced.

The smaller the gap D between the first rectifier vane 46 and the second rectifier vane 48 may be, the smaller the ventilation resistance can be. Nevertheless, if the first rectifier vane 46 and the second rectifier vane 48 are in contact with each other, the airflow produced by the intake fan 50 causes the first rectifier vane 46 and the second rectifier vane 48 to vibrate and collide with each other, generating noise. In contrast, if the gap D is large, air flowing in the vertical direction may flow into the gap D, disturb the airflow produced by the intake fan 50, and act as a ventilation resistance to the airflow produced by the intake fan 50. If the gap D exceeds 1 mm, the ventilation resistance may increase. Any gap D between the first rectifier vane 46 and the second rectifier vane 48 that falls within the range of 0.1 mm to 1 mm corresponds to a gap wherein the first rectifier vane 46 and the second rectifier vane 48 do not interfere with each other, and air from other places is restrained from flowing into the gap D. Consequently, the ventilation resistance to the airflow produced by the intake fan 50 is reduced, and the cooling effect may be increased without using a high-speed rotation of the fan. Moreover, the power consumed in driving the intake fan 50 may be reduced.

The first rectifier vane 46 and the second rectifier vane 48 preferably incline such that the outer end faces 46*c* and 48*c* thereof are at lower positions than the inner end faces 46*d* and 48*d* thereof, respectively, and at an angle of inclination A falling within a range of 15° to 25°. In such a configuration, a sound-insulating effect is produced against the sound generated by the rotation of the intake fan 50, and a reduction in the volume of airflow due to ventilation resistance is suppressed. The first rectifier vane 46 and the second rectifier vane 48 may alternatively be inclined such that the outer end faces 46*c* and 48*c* thereof are at higher positions than the inner end faces 46*d* and 48*d* thereof, respectively, and at an angle of inclination A falls within the range of 15° to 25°.

While the gap D between the first rectifier vane 46 and the second rectifier vane 48 is set small enough to fall within the specific range, the inner end face 48*d* of the second rectifier vane 48 is located on the outer side with respect to the exterior surface of the side cover 37. In such a configuration, the first louver 41 and the second louver 43 are spaced apart from the intake fan 50, and the ventilation resistance to the airflow produced by the intake fan 50 is reduced.

The above embodiment relates to a configuration in which outside air is pulled into the apparatus body 1*a* by using the intake fan 50, which is an axial-flow fan. The present disclosure is not limited to such an embodiment. Air inside the apparatus body 1*a* may be exhausted to the outside by using an axial-flow exhaust fan. In such a configuration also, the effects produced in the above embodiment are produced.

The above embodiment concerns a configuration in which the first louver 41 is included in the openable cover 40. The present disclosure is not limited to such an embodiment. The first louver 41 may be included in an immovable member such as an exterior cover. The first louver 41 and the second louver 43 may alternatively be included in the apparatus body 1*a*, as long as the first louver 41 and the second louver 43 overlap each other in the direction of the axis of rotation of the fan. In such a configuration also, the effects produced in the above embodiment are produced.

Figure 5:
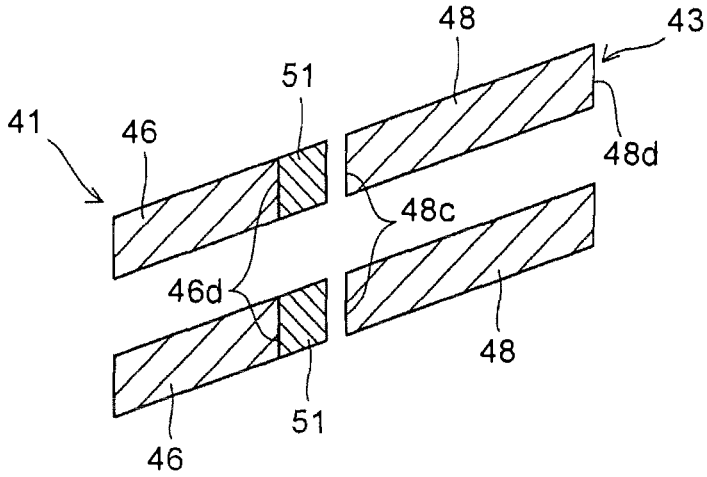
FIG. 5 is an enlarged sectional view illustrating part of a first louver and part of a second louver according to another embodiment of the present disclosure.

FIG. 5 is an enlarged sectional view schematically illustrating part of a first louver 41 and part of a second louver 43 according to another embodiment of the present disclosure. In this embodiment, filler members 51 are positioned between the first louver 41 and the second louver 43. The following description mainly concerns the filler members 51, which are the principal difference from the previous embodiment, and description of elements that are the same as those described in the previous embodiment is omitted.

The filler members 51 are made of a deformable porous material such as sponge. The filler members 51 are each positioned between the inner end face 46*d* of a corresponding one of the first rectifier vanes 46 and the outer end face 48*c* of a corresponding one of the second rectifier vanes 48, whereby the gap between the first rectifier vane 46 and the second rectifier vane 48 is reduced. By reducing the gap between the first rectifier vane 46 and the second rectifier vane 48, airflow passing through the gap in the vertical direction is suppressed so that the ventilation resistance to the airflow produced by the intake fan 50 is reduced. One end of the filler member 51 is attached to the inner end face 46*d* of the first rectifier vane 46 with adhesive or the like, while the other end of the filler member 51 is located near or is deformably in contact with the outer end face 48*c* of the second rectifier vane 48. Alternatively, one end of the filler member 51 may be attached to the outer end face 48*c* of the second rectifier vane 48 with adhesive or the like, while the other end of the filler member 51 may be located near or be deformably in contact with the inner end face 46*d* of the first rectifier vane 46.

Figure 6:
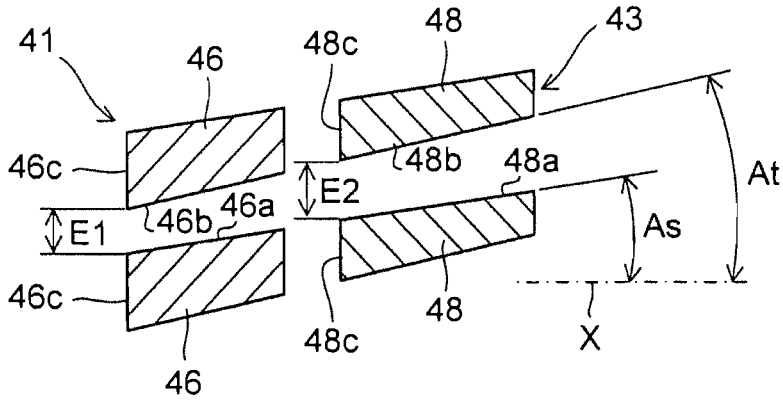
FIG. 6 is an enlarged sectional view illustrating part of a first louver and part of a second louver according to a further embodiment of the present disclosure.

FIG. 6 is an enlarged sectional view schematically illustrating part of a first louver 41 and part of a second louver 43 according to a further embodiment of the present disclosure. This embodiment concerns configurations of the first rectifier vane 46 and the second rectifier vane 48 that are suitable for the situation where the outside air is pulled into the apparatus body 1*a* by the intake fan 50.

The first rectifier vane 46 has a substantially trapezoidal sectional shape extending in the direction of the axis of rotation X of the fan. The second rectifier vane 48 has a substantially trapezoidal sectional shape extending in the direction of the axis of rotation X of the fan.

The upper surface 46*a* of the first rectifier vane 46 and the upper surface 48*a* of the second rectifier vane 48 extend in the same plane and incline at an angle of inclination As with respect to the axis of rotation X of the fan. The lower surface 46*b* of the first rectifier vane 46 and the lower surface 48*b* of the second rectifier vane 48 extend in the same plane and incline at an angle of inclination At with respect to the axis of rotation X of the fan. The angle of inclination At is greater than the angle of inclination As. Hence, a gap E2 between the outer end faces 48*c* of adjacent ones of the second rectifier vanes 48 is greater than a gap E1 between the outer end faces 46*c* of adjacent ones of the first rectifier vanes 46.

In such a configuration, in the situation where outside air is pulled into the apparatus body 1*a* by the intake fan 50, the airflow produced by the intake fan 50 is directed and outside air is efficiently taken into the apparatus body 1*a*.

Figure 7:
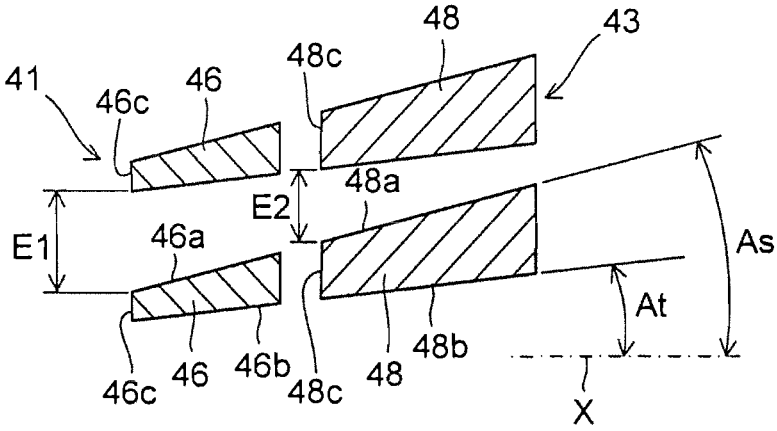
FIG. 7 is an enlarged sectional view illustrating part of a first louver and part of a second louver according to a still further embodiment of the present disclosure.

FIG. 7 is an enlarged sectional view schematically illustrating part of a first louver 41 and part of a second louver 43 according to a still further embodiment of the present disclosure. This embodiment concerns configurations of the first rectifier vane 46 and the second rectifier vane 48 that are suitable for the situation where air inside the apparatus body 1*a* is exhausted to the outside by an exhaust fan.

The first rectifier vane 46 has a substantially trapezoidal sectional shape extending in the direction of the axis of rotation X of the fan. The second rectifier vane 48 has a substantially trapezoidal sectional shape extending in the direction of the axis of rotation X of the fan.

The upper surface 46*a* of the first rectifier vane 46 and the upper surface 48*a* of the second rectifier vane 48 extend in the same plane and incline at an angle of inclination As with respect to the axis of rotation X of the fan. The lower surface 46*b* of the first rectifier vane 46 and the lower surface 48*b* of the second rectifier vane 48 extend in the same plane and incline at an angle of inclination At with respect to the axis of rotation X of the fan. The angle of inclination As is greater than the angle of inclination At. Hence, a gap E1 between the outer end faces 46*c* of adjacent ones of the first rectifier vanes 46 is greater than a gap E2 between the outer end faces 48*c* of adjacent ones of the second rectifier vanes 48.

In such a configuration, in the situation where air inside the apparatus body 1*a* is exhausted to the outside by an exhaust fan, the airflow produced by the exhaust fan is directed and air inside the apparatus body 1*a* is efficiently exhausted to the outside.

The above embodiments each concern a configuration in which the first louver 41 and the second louver 43 include a plurality of first rectifier vanes 46 and a plurality of second rectifier vanes 48, respectively, that are arranged side by side in the vertical direction. The present disclosure is not limited to such an embodiment. The plurality of first rectifier vanes 46 and the plurality of second rectifier vanes 48 may be arranged side by side in the horizontal direction. Moreover, the plurality of first rectifier vanes 46 and the plurality of second rectifier vanes 48 may be arranged side by side in an oblique direction at a specific angle with respect to the horizontal direction (or with respect to the vertical direction). In any of the foregoing configurations, the first rectifier vanes 46 and the second rectifier vanes 48 may be arranged such that the outer end faces 46*c* and 48*c* incline toward the rear cover or the front cover.

Now, by way of example, Examples 1 to 4 as more specific examples of the above embodiments of the present disclosure and Comparative Examples 1 and 2 will be described. The present disclosure is not limited to the examples described below.

Using the first louver 41 and the second louver 43 according to an embodiment (see FIG. 4), working examples and comparative examples were set as summarized in Table 1 for the following items: gap D (in mm) between the first louver 41 and the second louver 43, aperture efficiency (in %), angle of inclination A (in degrees) of each rectifier vane, thickness T (length of the outer end face, in mm) of the rectifier vane, voltage (in V) applied to the exhaust fan used as the fan, and so forth. Based on such settings, the volume of airflow (in $mm^3$/min) and the intensity of sound (noise, in dB) generated by the rotation of the fan and transmitted to the outside of the apparatus body 1*a* were measured. Table 1 summarizes the configurational data on the individual working examples and comparative examples and the results of measurements of the volume of airflow and the noise, which was measured twice, for each of those configurational data. The aperture efficiency refers to the percentage of a gap E between the end faces of adjacent ones of the rectifier vanes that are arranged side by side in the vertical direction with respect to the sum of the thickness T of each rectifier vane and the gap E. The volume of airflow refers to the volume of air exhausted from the fan per minute that is measured with an airflow meter provided immediately after the exhaust port of the fan and is obtained by multiplying the measured wind speed by the area of the fan.

TABLE 1

| | Louver Gap D (mm) | Aperture efficiency (%) | Vane inclination A (°) | Vane thickness T (mm) | Fan voltage (V) | Volume of airflow ($mm^3$/min) | Noise (dB) 1st | Noise (dB) 2nd |
|---|---|---|---|---|---|---|---|---|
| Comparative Example 1 | 2 | 51.9 | 20 | 6 | 13.4 | 0.892 | 31.91 | 31.76 |
| Comparative Example 2 | 0 | 51.9 | 20 | 6 | 13.4 | 0.953 | 29.79 | 29.85 |
| Working Example 1 | 1 | 51.9 | 20 | 6 | 13.4 | 0.938 | 30.40 | 30.49 |
| Working Example 2 | 0.5 | 51.9 | 20 | 6 | 13.4 | 0.944 | 30.08 | 29.99 |
| Working Example 3 | 0.5 | 51.9 | 10 | 6 | 12.6 | 0.944 | 30.63 | 30.45 |

TABLE 1-continued

| | Louver Gap D (mm) | Aperture efficiency (%) | Vane inclination A (°) | Vane thickness T (mm) | Fan voltage (V) | Volume of airflow ($mm^3$/min) | Noise (dB) 1st | Noise (dB) 2nd |
|---|---|---|---|---|---|---|---|---|
| Working Example 4 | 0.5 | 51.9 | 30 | 6 | 14.4 | 0.944 | 32.82 | 32.91 |

Referring to Table 1, Comparative Examples 1 and 2 and Example 1 are compared, in which the gap D between the louvers was varied while the number of revolutions of the fan (the voltage of the fan) was fixed. In Comparative Example 1, the gap D between the louvers was too large (D=2 mm), the volume of airflow was small, and the noise was loud. In Comparative Example 2, the volume of airflow was large and the noise was small, whereas it was difficult to attach the louvers with a gap D of zero. In Comparative Example 2, noise was generated by the airflow from the fan because adjacent ones of the rectifier vanes vibrated and collided with each other. In contrast, Example 1 showed good results in that the volume of airflow was relatively large and the noise was small. In Examples 2 to 4, the gap D between the louvers were fixed, and the angle of inclination A of each rectifier vane was varied for comparison. In Example 4, since the angle of inclination A was large, the ventilation resistance became large and the noise was louder than in Examples 2 and 3 while the volume of airflow was large. In Examples 2 and 3, the ventilation resistance was small. Therefore, air was efficiently moved, and the noise was small. Particularly, in Example 2 in which the angle of inclination A of each rectifier vane was 20°, the noise was smaller than in Working Example 3 in which the angle of inclination A of each rectifier vane was 10°, in spite of a large number of revolutions of the fan (a high voltage applied to the fan).

The present disclosure is applicable to image forming apparatuses such as copiers, printers, facsimiles, and multifunction machines each having the foregoing functions, and particularly to an image forming apparatus including louvers that direct airflow produced by a fan that cools the inside of an apparatus body.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

a fan that is configured to pull outside air into an apparatus body or to exhaust air inside the apparatus body to an outside;

a first louver including a plurality of first rectifier vanes configured to direct airflow produced by the fan;

a second louver that is located on an inner side of the apparatus body with respect to the first louver and faces the first louver in such a manner as to overlap the first louver in a direction of an axis of rotation of the fan, the second louver including a plurality of second rectifier vanes configured to direct the airflow produced by the fan; and deformable filler members located between the first louver and the second louver and attached to inner end faces of the respective first rectifier vanes or to outer end faces of the respective second rectifier vanes, wherein front surfaces of each of the first rectifier vanes and a corresponding one of the second rectifier vanes that is adjacent thereto extend in one plane inclining at a specific angle with respect to the axis of rotation of the fan, and wherein back surfaces of each of the first rectifier vanes and a corresponding one of the second rectifier vanes that is adjacent thereto extend in one plane inclining at a specific angle with respect to the axis of rotation of the fan.

2. The image forming apparatus according to claim 1, wherein a gap between the first rectifier vane and the second rectifier vane that is adjacent thereto is 0.1 mm to 1 mm.

3. The image forming apparatus according to claim 1, wherein a gap between the first rectifier vane and the second rectifier vane that is adjacent thereto is 0.5 mm to 1 mm.

4. The image forming apparatus according to claim 1, wherein the front surfaces of the first rectifier vanes and the second rectifier vanes and the back surfaces of the first rectifier vanes and the second rectifier vanes incline at an angle of 15 degrees to 25 degrees with respect to the axis of rotation of the fan.

5. The image forming apparatus according to claim 1:

wherein the second louver is located on an exterior cover; and wherein inner end faces of the second rectifier vanes are located on an outer side with respect to an exterior surface of the exterior cover.

* * * * *